US005315081A

United States Patent [19]

Hartmann et al.

[11] Patent Number: 5,315,081

[45] Date of Patent: May 24, 1994

[54] VACUUM SWITCHING TUBE FOR LOW-VOLTAGE AND MEDIUM-VOLTAGE SWITCHES, PARTICULARLY FOR VACUUM CONTACTORS

[75] Inventors: Werner Hartmann, Roettenbach; Horst Kippenberg, Herzogenaurach, both of Fed. Rep. of Germany

[73] Assignee: Siemens Aktiengesellschaft, Munich, Fed. Rep. of Germany

[21] Appl. No.: 41,303

[22] Filed: Mar. 31, 1993

[30] Foreign Application Priority Data

Mar. 31, 1992 [DE] Fed. Rep. of Germany ..... 4210616

[51] Int. Cl.[5] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 4,446,346 | 5/1984 | Kashimoto et al. | 200/144 B |
| 4,546,222 | 10/1985 | Watanabe et al. | 200/144 B |
| 4,614,850 | 9/1986 | Kuhl et al. | 200/144 B |
| 4,672,156 | 9/1987 | Basnett | 200/144 B |

*Primary Examiner*—J. R. Scott

*Attorney, Agent, or Firm*—Kenyon & Kenyon

[57] ABSTRACT

A vacuum switching tube contains a switching chamber and a first contact piece fixed in place in it, as well as a movable current conducting rod with a second contact piece and a ring-shaped insulator. According to the present invention, the ring-shaped insulator has at least one end surface on the vacuum side, which is at least partially free of metallization, and which faces away from the metal vapor formed during switching and is therefore protected against condensation. It is advantageous if a gap with a pre-determined length and height is formed by the end surface of the insulator and by at least one adjacent metallic flange.

9 Claims, 2 Drawing Sheets

VACUUM SWITCHING TUBE FOR LOW-VOLTAGE AND MEDIUM-VOLTAGE SWITCHES, PARTICULARLY FOR VACUUM CONTACTORS

BACKGROUND OF THE INVENTION

The present invention relates generally to vacuum switching tubes for low-voltage and medium-voltage switches, and more particularly to vacuum contactors having a switching chamber and a first contact piece fixed in place in the switching chamber, as well as a movable current conducting pin with a second contact piece and a ring-shaped insulator.

Many various versions of vacuum switches are presently available in the industry. The purpose of such switches is to allow current flow by closing an open switch, to conduct current in a closed state of the switch, and to interrupt current flow by opening the switch. In the closed state of the switch, the two contact pieces touch mechanically at the contact surfaces, and thus allow an electrically conductive connection, i.e., current can flow. In contrast, in the open state of the switch, the two contact pieces are mechanically separated, so that the insulation medium of the vacuum does not permit any current flow between the contact pieces.

When the switch is mechanically opened under a load, i.e. when there is current flow and the switch is opened, a metal vapor arc occurs due to local overheating at the contact site, producing a conductive connection between the contacts. The switch only opens electrically in the vicinity of the current zero crossing at the end of a current half-wave. If the metal vapor cools rapidly enough during a current zero crossing and condenses at cool regions of the switch, a sufficiently conductive medium (plasma) no longer exists. The recurrent voltage is present at the two contact pieces and thus also at the insulator, if the switch has opened successfully.

The latter insulator is ring-shaped, due to the structure of vacuum switches, which are usually in the form of hollow cylinders, and must have high insulation capacity both in the interior region of the tube and in the exterior region, until the end of the useful lifetime of the switch. A significant design objective in the implementation of a vacuum switching tube consists of designing enough vapor surfaces for cooling and condensation of the metal vapor, but at the same time preventing condensation on the vacuum side of the insulator in those regions which are necessary for maintaining the voltage withstand capability.

In the case of known vacuum switches, the region of the insulator required to achieve the necessary voltage withstand capability, in a vacuum is frequently protected against evaporation by one or more metallic shields. For example, in the vacuum switch disclosed in DE-B-38 40 192, the center part of the ring-shaped insulator is protected by a special vapor shield in the shape of a hollow cylinder, affixed in the interior region of the switch. Also, a vacuum switch for the low-voltage range, to be used as a low-voltage contactor, is disclosed in EP-B-0 149 061. The vacuum switch in this configuration has an insulator, which on the vacuum side relative to the contact pieces, is covered by a shield structured as a concentric hollow cylinder. The axial length of the shield is at least 1.5 times the length of the ring-shaped insulator. The ring-shaped insulator of ceramic material is connected on one side with a metal bellows extending around the vacuum switching tube and surrounding the movable current conducting rod. The outside circumference of the shielding cylinder has a radial distance between 0.5 and 3 mm. from the inside circumference of the ring-shaped insulator and from the inside circumference of the bellows.

The structure and production of such hollow cylinder vapor shields involve significant effort and expense. It has already been proposed that to avoid separate vapor shields, the wall thickness of the insulator be increased, and the insulator be provided with indentations on the side facing away from the switch contacts, so that a part of the insulator itself takes over the function of the vapor shield. Such a solution, however, requires the use of more material, and greater production effort and expenditure for the insulator, resulting in corresponding higher costs.

Furthermore, a vacuum housing for circuit breakers capable of functioning without vapor shields is known from DE-A-37 09 585. For this purpose, the movable current conducting rod is surrounded by a ceramic element, which causes a narrowing of the passage cross-section between the switching chamber in which the arc occurs when the breaker is opened, and a folded bellows, designated as a corrugated tube, located behind the ceramic element. The ceramic element shields the folded bellows from the arc. However, this reference discloses nothing concerning the insulation strength.

The present invention is directed to the problem of developing vacuum switching tubes for low-voltage and medium-voltage applications, which do not necessarily require vapor shields to maintain the insulation capacity when the switching segment is open, and which, in particular, do not have any steps or undercuts on the inside of the insulator that would complicate the production of these tubes.

SUMMARY OF THE INVENTION

The present invention solves this problem by providing that the ring-shaped insulator have at least one end surface on the vacuum side, which is at least partially free of metallization, and which faces away from the metal vapor formed during switching. Thus, the end surface is therefore protected from metal vapor condensation. To further protect the end surface from metal vapor condensation, the free end surface of the insulator has a radial extension on the vacuum side that is sufficient to perform the insulation function in the vacuum. Preferably, this radial extension of the end surface is at least approximately 0.5 mm.

In an advantageous further development of the present invention, a gap with a pre-determined length and height is formed by the end surface of the insulator and at least one adjacent metallic flange, where the metallization of the insulator necessary for the vacuum technology connection between the flange and the insulator lies outside of the gap. The height of the gap is smaller than or equal to the radial extension of the end surface of the insulator. This ensures that the formation of the gap has lesser dimensions than the mean free path length of the metal vapor particles in the vacuum.

To guarantee the above measures, it is advantageous that the metallic flange and/or the folded bellows are connected with the ring-shaped insulator on its outside. Furthermore, the end surfaces of the insulator can be beveled at least towards one side. Instead of a bevel on both sides, the open end surface of the insulator can have a domed contour without edges. For the case that the ring-shaped insulator is connected with the base flange of the switching chamber, the base flange to hold the current conducting rod can be designed so that it is drawn into the switching tube.

Therefore, the hollow cylinder vapor shields required until now for protection of the insulator can be eliminated with the present invention. This is made possible by the fact that in the region of the end surface of the cylindrical insulator, a sufficient region is protected against condensation in each case, and the insulation function is guaranteed. It can be advantageous that the bellows is shielded by a vapor reflector at the end facing towards the contact pieces.

In the present invention, advantage is taken of the fact that clearly shorter distances are sufficient for insulation segments in a vacuum as compared to in air. Thus, 1 mm, for example, can be sufficient. This means that only a relatively small part in the interior of the vacuum switching tube is needed to maintain the insulation capacity, compared with the total insulator length resulting from the requirements under atmospheric conditions.

DETAILED DESCRIPTION

Figure 1:
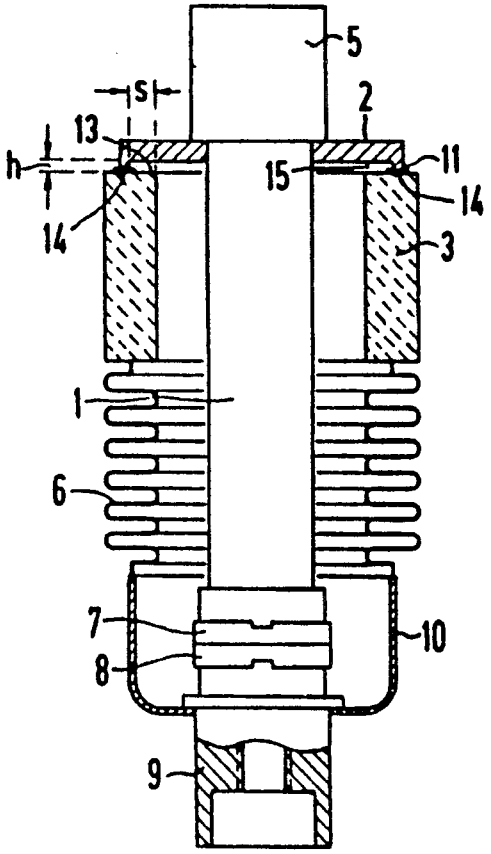
FIG. 1 depicts a cross section of a switching tube in which the insulator lies on the side facing away from the switching chamber.
Figure 2:
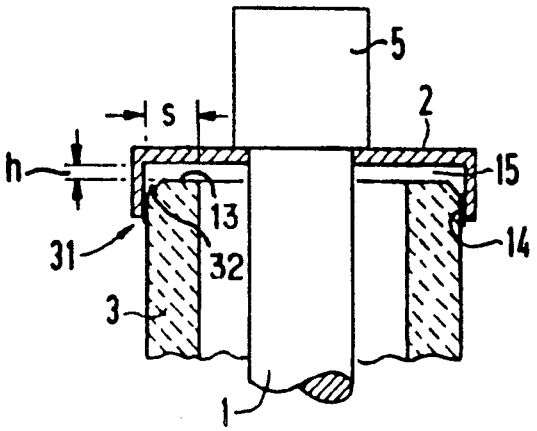
FIGS. 2 and 3 depict a cross section of two variants of FIG. 1.
Figure 3:
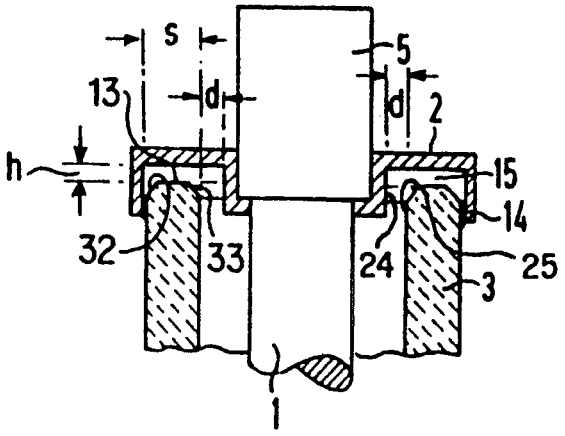

Throughout the drawings, the same parts are provided with the same reference symbols. The following discussion relates in part to all of the figures. The switching tubes shown in the individual figures are particularly intended for contactor applications, i.e. the switches are specifically supposed to have a lifetime of at least $10^6$ switchings. In FIGS. 1 to 3, the switching tube consists of a base flange 2 on the one side of a ring-shaped insulator 3, which insulator is extended axially by a bellows 6, and a metal cap 10 to form the actual switching chamber as the end piece on the other side. In the switching tube formed in this way, there are two contact pieces 7 and 8, one of which is fixed in place on the switching chamber, and is connected to a first external current feed 9, and the other of which is affixed to a current conducting rod 1 with an external current feed 5. The two contact pieces 7 and 8 can move relative to one another in the axial direction via the spring bellows 6, to be able to perform the switching movements necessary for opening and closing the switch.

In FIG. 1, the flange 2 which carries the contact feed 1 is connected with the ring-shaped insulator 3 on its end surface, in terms of vacuum technology, via a metallization 14. According to the state of the art, such a connection is most often produced by hard-soldering, for which purpose the insulator end surface must be metallized. In the present invention, the metallization 14 is limited to a narrow, outside ring surface, in deviation from the usual practice until now, and leaves a non-metallized (or exposed) end surface 13 of the insulator 3 exposed on the vacuum side.

The flange 2 is structured as a molded or lathed part, in such a way that it has a cut edge 11 on its circumference. This guarantees good dimensional accuracy, so that a defined contact point on the metallization ring 14 on the end surface of the insulator is pre-determined. When the cut edge 11 is soldered onto the insulator 3, a distance h between the exposed insulator end surface 13 and the flange 2 is pre-determined, corresponding approximately to the height of the cut edge.

Thus, a radial region is present, in the form of the non-metallized end surface 13 of the ring-shaped insulator 3, which is protected against condensation by the insulator 3 itself, and which guarantees insulation of the voltage present in the open state of the switch, if sized appropriately. Usually, the ring-shaped insulator 3 has a wall thickness such that it lies in the range of several mm, e.g. 5 mm. By soldering the flange 2 near the outside edge of the insulator 3, as indicated, the non-metallized insulator surface 13 can be kept exposed as a defined region with the radial length s, to be used exclusively for insulation purposes. Its expanse is at least 0.5 mm and can amount to as much as several mm. An insulation length of about 1 mm has proven to be sufficient for low-voltage applications ($<1000$ V) in practice.

Between the flange 2 and the exposed end surface 13 of the ring-shaped insulator 3, there is a gap 15 with the above arrangement, the height h of which is lower than the radial length s. Usually, a gap height of $h=0.5$ mm can be achieved. The gap height h is smaller in each case than the mean path length of metal vapor particles available in the region of the switching tube facing away from the contact pieces 7 and 8, which generally is on the order of centimeters. The region of the insulator 3 protected against condensation can be enlarged in that the insulator 3 is beveled in the region of the edges, which causes the voltage withstand capability in this region to be increased and allows an application also in the medium-voltage range ($<2000$ V).

Also in the embodiment according to FIG. 1, it can be practical to shield the bellows 6, specifically, by a vapor reflector. Such a vapor reflector can be affixed on the contact piece 7, or on the feed rod 1.

In the example according to FIG. 2, the flange 2 is connected with the ring-shaped insulator 3 by means of a solder connection 31 with metallization ring 14, which surrounds the circumference of the insulator 3 from the outside. In this way, the insulating region, which is protected against condensation, is maximized in its radial expanse on the end surface 13 of the insulator 3 which is free of metallization. Furthermore, the outside edge of the insulator 3 is beveled at a slant 32 in the end region. In addition to increasing the insulating region which is protected against condensation, the electrical field intensity is particularly lowered in this way, both perpendicular to the surface of the insulator 3 and its portion parallel to the insulator surface.

In FIG. 3, the flange 2 is formed in such a way that it projects over the inside edge of the ring-shaped insulator 3 into the interior of the switching tube, where a distance d is maintained between the insulator 3 and the flange surface, particularly in the vertical region, in such a way that it is sufficient to maintain the voltage withstand capability even when the inner mantle surface of the insulator 3 has vapor condensed on it. In this embodiment, the end surface 13 of the insulator 3 is therefore additionally protected by the flange 2, which is indented into the interior of the tube, against the metal vapor which is formed during the switching process it is practical if the edges of the insulator 3 are beveled on both sides at slants 32 and 33 in this example. Particularly advantageous results are achieved if the free end surface has a domed contour without edges.

Instead of indenting the flange 2 into the switching tube, the same effect can be achieved if the contact rod 1 is correspondingly thickened in the region of the insulator end surface to be protected.

Figure 4:
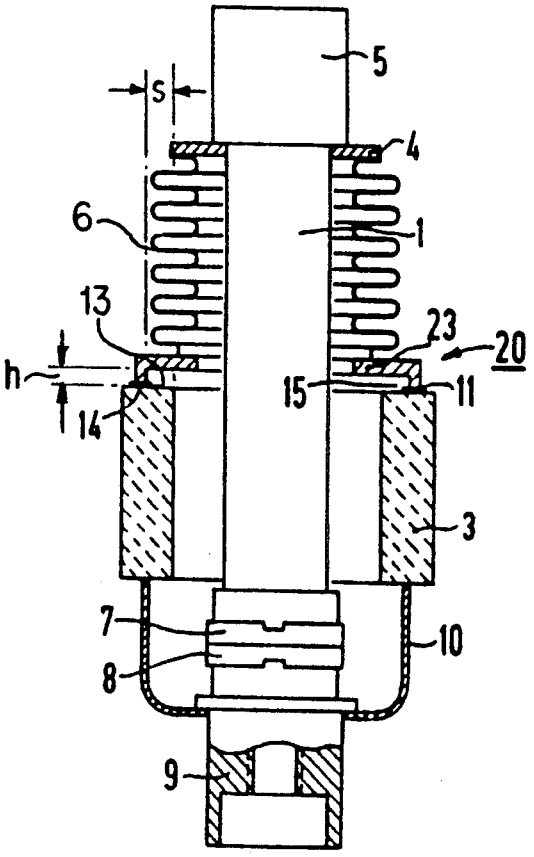
FIG. 4 depicts a cross section of a switching tube in which the bellows lies on the side facing away from the switching chamber.

In FIGS. 1 to 3, the bellows 6 is arranged near the actual switching chamber in each case. In an alternative embodiment shown in FIG. 4, the bellows 6 is arranged at the opposite end of the switching tube, with the ring-shaped insulator 3 following this on the switching chamber side. The bellows 6 is closed off with an end flange 4 with a contact feed 5 on the upper side, and is connected with the insulator 3 via a flange 20 to form the gap 15.

In this case, the bellows 6 is particularly shielded by a flange widening 23 which projects into the switching tube, for protection against metal drops. The flange widening 23 provides a shield for the metal bellows 6 on the one side, while the actual flange 20 defines the gap 15 towards the other side, with the end surface 13 of the insulator 3 which is free of metallization. In turn, the radial length s of the gap 15 again guarantees sufficient insulation length. The flange 20 can also be connected with the insulator at the circumference 31, according to FIG. 2.

What is claimed is:

1. In a vacuum switching tube for low-voltage and medium-voltage switches, including, a) a first contact piece disposed in a fixed position, b) a movable current conducting rod having a second contact piece for making an electrical contact with the first contact piece, and c) a switching chamber, consisting of a metallic cap surrounding the contact pieces, a metal bellows connected to the metallic cap and an isolator to provide a movable vacuum seal, the movable current conducting rod being connected via a metallic flange to an end of the isolator by a high vacuum sealing technique, wherein said isolator is a ring-shaped insulator body having a vacuum side and at least one end surface at least partially on the vacuum side, the improvement comprising:

said end surface of the ring-shaped insulator body is at least partially free of metallization and faces away from metal vapor formed during switching, whereby said end surface is protected against metal vapor condensation;

said partially unmetallized end surfaces has a radial expanse on the vacuum side which is sufficient to maintain an insulating function in the vacuum switching tube;

and the metallic flange connected to said end of the ring-shaped insulator body forming a gap with said insulator end surface, said gap having a predetermined length in the radial expanse and height in the axial expanse, respectively.

2. The vacuum switching tube according to claim 1, wherein the radial expanse of said unmetallized end surface comprises at least 0.5 mm.

3. The vacuum switching tube according to claim 1, where in the metallization of said end surface of the insulator body necessary for the high vacuum sealing technique between the flange and the insulator body occurs outside of the gap, further comprising at least one adjacent metallic flange forming a gap having a pre-determined length and height with the end surface of the insulator body.

4. The vacuum switching tube according to claim 1, wherein the height of the gap is smaller than or at most equal to a radial length of said end surface of the insulator body.

5. The vacuum switching tube according to claim 1, wherein the metallic flange is connected with the ring-shaped insulator body on the exterior of the insulator body.

6. The vacuum switching tube according to claim 1, wherein the end surface of the ring-shaped insulator body is beveled towards at least one side.

7. The vacuum switching tube according to claim 1, wherein said end surface of the insulator body comprises a domed contour without edges.

8. The vacuum switching tube according to claim 1, wherein the ring-shaped insulator body is connected with the metallic flange and the metallic flange is indented in the interior to hold the movable current conducting rod.

9. The vacuum switching tube according to claim 1, wherein the metal bellows is disposed at the end of the ring-shaped insulator body and a vapor reflector shielding the metal bellows at its end facing towards the first and second contact pieces.

* * * * *